US007287596B2

(12) United States Patent
Frazier et al.

(10) Patent No.: US 7,287,596 B2
(45) Date of Patent: Oct. 30, 2007

(54) METHOD AND APPARATUS FOR STIMULATING HYDROCARBON WELLS

(76) Inventors: W. Lynn Frazier, 5353 County Rd. 73, Robstown, TX (US) 78380; William W. Chapman, 7821 Van Zandt, Corpus Christi, TX (US) 78413

( * ) Notice: Subject to any disclaimer, the term of this patent is extended or adjusted under 35 U.S.C. 154(b) by 258 days.

(21) Appl. No.: 11/010,072

(22) Filed: Dec. 9, 2004

(65) Prior Publication Data

US 2006/0124315 A1 Jun. 15, 2006

(51) Int. Cl.
*E21B 34/06* (2006.01)

(52) U.S. Cl. ..... 166/332.8; 166/332.4

(58) Field of Classification Search ..... 166/386, 166/332.4, 332.8

See application file for complete search history.

(56) References Cited

U.S. PATENT DOCUMENTS

| | | | | |
|---|---|---|---|---|
| 2,368,428 | A | 1/1945 | Saurenman | |
| 3,289,762 | A | 12/1966 | Schell | |
| 4,427,071 | A | 1/1984 | Carmody | |
| 4,444,266 | A | 4/1984 | Pringle | |
| 4,478,286 | A * | 10/1984 | Fineberg | 166/324 |
| 4,637,468 | A | 1/1987 | Derrick | |
| 4,813,481 | A * | 3/1989 | Sproul et al. | 166/51 |
| 5,012,867 | A | 5/1991 | Kilgore | |
| 5,564,502 | A * | 10/1996 | Crow et al. | 166/386 |
| 5,924,696 | A | 7/1999 | Frazier | |
| 6,227,299 | B1 | 5/2001 | Dennistoun | |
| 6,328,112 | B1 * | 12/2001 | Malone | 116/386 |
| 6,386,288 | B1 | 5/2002 | Snider | |
| 6,536,524 | B1 | 3/2003 | Snider | |
| 6,543,538 | B2 | 4/2003 | Tolman | |
| 6,575,249 | B2 | 6/2003 | Deaton | |
| 6,732,803 | B2 | 5/2004 | Garcia | |
| 6,808,020 | B2 | 10/2004 | Garcia | |
| 2002/0125011 | A1 * | 9/2002 | Snider et al. | 166/297 |
| 2006/0124310 | A1 | 6/2006 | Lopez de Cardenas et al. | |
| 2006/0124311 | A1 | 6/2006 | Lopez de Cardenas et al. | |

* cited by examiner

*Primary Examiner*—William P Neuder
(74) *Attorney, Agent, or Firm*—Edmonds PC; Robb D. Edmonds

(57) ABSTRACT

One or more flapper valve assemblies are placed in a casing string extending through one or more hydrocarbon bearing intervals. The flapper valve assemblies are placed between some of the hydrocarbon bearing intervals. In an open or inoperative position, the flapper valve assemblies are full opening compared to the casing string. The hydrocarbon bearing intervals are stimulated, typically by fracing, starting with the bottom zone. The flapper valve assembly immediately above the stimulated interval is manipulated to allow it to close, preventing downward flow in the well and thereby isolating the lower stimulated interval so an upper interval can be stimulated. The well is easy to put on production because the flapper valves will normally open simply by opening the well at the surface.

13 Claims, 2 Drawing Sheets

METHOD AND APPARATUS FOR STIMULATING HYDROCARBON WELLS

This invention relates to a method and apparatus for completing hydrocarbon wells and more particularly to a technique for stimulating multiple zones in a single well and then cleaning up the well in preparation for production.

BACKGROUND OF THE INVENTION

An important development in natural gas production in recent decades, at least in the continental United States, has been the improvement of hydraulic fracturing techniques for stimulating production from previously uneconomically tight formations. For example, the largest gas field put on production in the lower forty eight states in the last twenty years is the Bob West Field in Zapata County, Tex. This field was discovered in the 1950's but was uneconomic using the fracturing techniques of the time where typical frac jobs injected 5,000-20,000 pounds of proppant into a well. It was not until the 1980's that large frac jobs became feasible where in excess of 300,000 pounds of proppant were routinely injected into wells. The production from wells in the Bob West Field increased from a few hundred MCF per day to thousands of MCF per day. Without the development of high volume frac treatments, there would be very little deep gas produced in the continental United States.

The fracing of deep, high pressure gas zones has continued to develop or evolve. More recently, multiple gas bearing zones encountered in deep vertical wells are fraced one after another. This is accomplished by perforating and then fracing a lower zone, placing a bridge plug in the casing immediately above the fraced lower zone thereby isolating the fraced lower zone and allowing a higher zone to be perforated and fraced. This process is repeated until all of the desired zones have been fraced. Then, the bridge plugs between adjacent zones are drilled out and gas from the fraced zones produced in a commingled stream. The result is a well with a very high production rate and thus a very rapid payout.

Another situation where multizone fracing has created commercial wells from previously non-commercial zones is in relatively shallow, moderately pressured tight gas bearing sands and shales, of which the Barnett Shale west of Fort Worth, Tex., is a leading example. By fracing multiple zones of the Barnett Shale, commercial wells are routinely made where, in the past, only non-economic production was obtained.

It is no exaggeration to say that the future of gas production in the continental United States is from heretofore uneconomically tight gas bearing formations. Accordingly, a development that allows effective frac jobs at overall lower costs is important.

Disclosures of interest relative to this invention are found in U.S. Pat. Nos. 2,368,428; 3,289,762; 4,427,071; 4,444,266; 4,637,468; 4,813,481; 5,012,867; 6,227,299; 6,575,249 and 6,732,803.

SUMMARY OF THE INVENTION

In this invention, one or more check valves, preferably in the form of full opening flapper valves, are provided in a casing string cemented in the earth. When it is desired to conduct sequential stimulation operations in the well, such as fracing, acidizing or otherwise treating a series of spaced hydrocarbon bearing zones, a lowermost zone, in the case of a vertical well, or a most distant zone, in the case of a horizontal well, is perforated and treated. The check valve is then manipulated or installed to isolate the lower zone by preventing downward flow in the well and allowing upward flow. The advantage of the check valves, as contrasted to prior art bridge plugs, is the potential for putting the well on production, simply by opening the casing string to the atmosphere or to production equipment at the surface. Provided that the pressure below a particular check valve is sufficient to crack open the check valve, gas from below will fluidize any sand or debris on top of the check valve and then blow it out of the well so the check valve can fully open and provide a minimum hindrance to the flow of hydrocarbons in the well.

The preferred flapper valves are run on the casing string and cemented in the earth. The flapper valves are initially held in a retracted or stowed position providing an opening therethrough the same size as the internal diameter of the casing string, allowing the expeditious circulation of cement, frac slurry or other materials down the casing string. The flapper valve is later manipulated to move to an operative position allowing upward flow in the casing string and preventing downward flow to isolate a lower stimulated zone and thereby allowing stimulation of an upper zone.

An upper zone in the case of a vertical well or zone less distant from the surface in the case of a horizontal well is then perforated and treated. A flapper valve above the second treated zone is manipulated to prevent pumping into the second zone. This process is repeated until all of the desired zones have been treated.

The well is then put onto production, either by drilling out or breaking the check valves and opening the well at the surface, or simply by opening the well to the atmosphere or to production equipment at the surface. In the absence of sand or other debris on top of a check valve, the pressure differential across the check valve is sufficient to open it and allow the treated zones to produce formation contents, thereby cleaning up the well and allowing it to be put on production. Even if debris is on top of the check valve, there is usually enough pressure differential to lift the valve member slightly, thereby allowing hydrocarbons from below to fluidize the debris above the valve and thereby allow it to open, whereupon the fluidized debris will be produced at the surface.

The preferred flapper valves are preferably made of a material which is readily disintegrated, e.g. it may be frangible so it is easily drilled or broken or may be digestible, such as acid soluble. In the best case scenario, the well is put onto production after multiple sequential stimulation jobs simply by opening the well at the surface and allowing the flapper valves to open, allowing upward flow in the well. In the worst case scenario, debris above one more flapper valves will have to be cleaned out and the flapper valve drilled out or broken. Although a coiled tubing unit may be used to drill out or break a flapper valve of this invention, a much less expensive alternative is available. If there is debris on top of the flapper valve, it may be bailed out using a simple slickline unit with a bailer on the bottom of the wireline. If, after bailing, the flapper valve will not open, it may be broken with a sinker bar or other impact device dropped or run in the well with a slickline. Because the flapper valves are full opening, working below one of the valves is easily done because necessary tools pass through the valved opening.

It is an object of this invention to provide an improved well configuration allowing expeditious stimulation of multiple zones in a vertical or horizontal well.

A further object of this invention is to provide an improved valve for use in a vertical or horizontal well to prevent downward flow in the well.

Another object of this invention is to provide an improved method of stimulating multiple zones in a horizontal or vertical well.

These and other objects and advantages of this invention will become more apparent as this description proceeds, reference being made to the accompanying drawings and appended claims.

DETAILED DESCRIPTION

Figure 1:
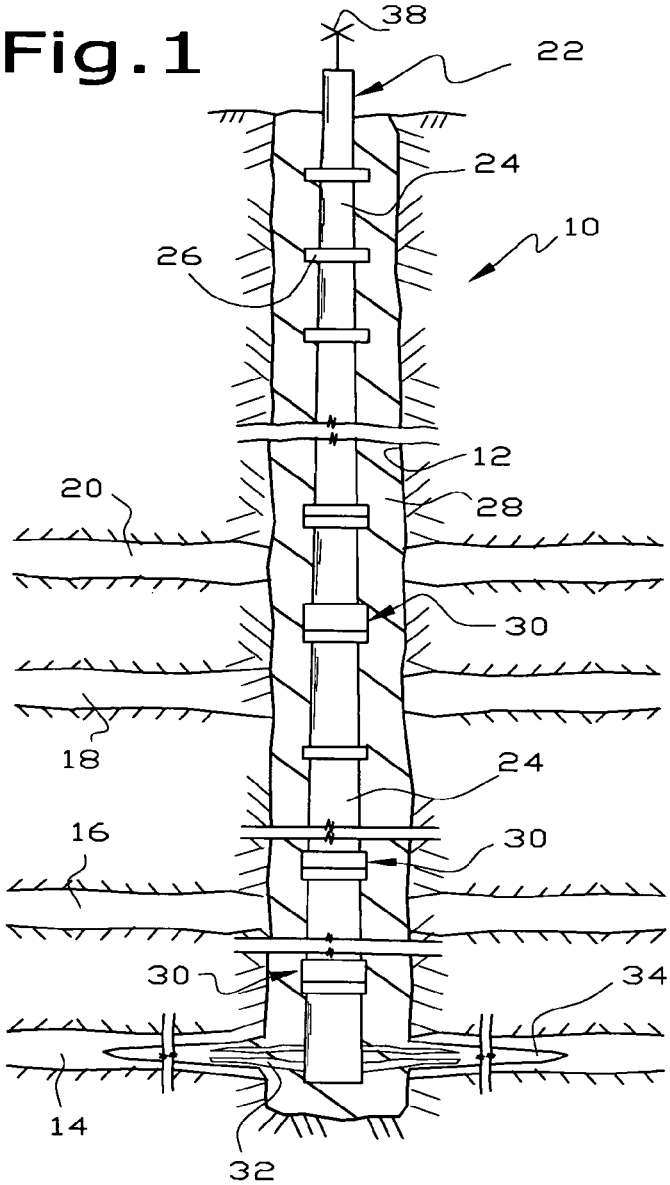
FIG. 1 is a cross-sectional view of a vertical well extending into the earth.

Referring to FIG. 1, there is illustrated a vertical hydrocarbon producing well 10 comprising a bore hole 12 extending from a surface location through the earth to penetrate a series of hydrocarbon bearing intervals or formations 14, 16, 18, 20. A casing string 22 comprises a series of pipe joints 24 having a threaded coupling 26 connecting adjacent joints 24 together. The casing string 22 is permanently placed in the bore hole 12 in any suitable manner, as by conventional cementing to provide a cement sheath 28 preventing communication between adjacent zones. Flapper valve assemblies can be positioned in the casing string 22 at locations between the hydrocarbon bearing intervals 14, 16, 18 for the purpose Of isolating any lower zone from zones above it so the tipper zone can be stimulated without affecting, or being affected by, the lower zone. In one or more embodiments, a flapper valve assembly 30 is placed above every zone, except the uppermost zone, to be stimulated in order to isolate the zone immediately below the flapper valve assembly 30.

After the casing string 22 is cemented in place, access to the lowermost zone 14 is provided in any suitable manner. For example, a shiftable sleeve may be provided in the casing string 22 to provide access to the zone 14. More normally, the lowermost zone 14 is perforated with suitable perforating equipment to produce passages or perforations 32 communicating between the formation 14 and the interior of the casing string 22. The formation 14 is then stimulated in any suitable manner, such as by the injection of acid or more typically by fracing in which a proppant laden slurry is pumped through the casing string 22 and perforations 32 to create a fraced area 34 in the formation 14. In a conventional manner, the fraced area 34 may extend many hundreds of feet away from the casing string 22 to produce a high permeability path from the formation 14 to the well 10.

In a maimer more fully explained hereafter, the lowermost flapper valve assembly 30 is then manipulated to prevent downward flow in the casing string 22 and allowing upward flow. This isolates the zone 14 and allows the next adjacent interval 16 to be perforated and stimulated, typically but not necessarily by fracing. After the interval 16 is treated, the flapper valve assembly 30 above the interval 16 is manipulated to isolate the interval 16 and allow the zone 18 to be perforated and treated if necessary. Alter the interval 18 is treated, the flapper valve assembly 30 above the interval 18 is manipulated to isolate the interval 18 and allow the interval 20 to be perforated and stimulated. It will accordingly be seen that any number of intervals may be selectively perforated and stimulated by the use of this invention.

After all of the intervals have been stimulated, the well 10 is initially produced in order to clean up the well, i.e. produce any frac liquid or flowable proppant, produce any mud filtrate or other by-products of the drilling or completion operation from adjacent the well bore 12 and the like. Initially, this is attempted simply by opening the well 10 to the atmosphere or to surface production equipment (not shown) by opening one or more valves 38. If there is no debris on top of the flapper valve members 36, the pressure differential across the valve members causes the members to open thereby allowing upward flow of formation contents to the surface. The well 10 is accordingly put on production without any further substantial cost relating to cleaning up the well. This is in contrast to the current practice of drilling out bridge plugs with a coiled tubing unit which is a costly and not riskless endeavor.

If there is some debris on top of the flapper valve members 36, but not too much, the pressure differential across the flapper valve members 36 is sufficient to partly open the valve members 36 allowing formation contents from below any particular flapper valve assembly to fluidize the debris and flow it to the surface. The well 10 is accordingly put on production without any further substantial cost relating to cleaning up the well.

If there is enough debris on top of any particular flapper valve member to prevent it from opening, the debris must be removed. This may be accomplished in a variety of ways, the simplest and least expensive of which is to rig up a wireline unit and bail out enough of the debris to allow the flapper valve member 36 to open. If the flapper valve member 36 won't open, it may be broken by placing a sinker bar on the end of the wireline and dropping the sinker bar on the closed flapper valve member 36. Because the flapper valve member 36 is preferably made of a frangible material, the member 36 will shatter thereby permanently opening the flapper valve assembly 30. In the alternative, the valve member 36 may be digestible, e.g. made of an acid soluble material, such as aluminum or its alloys, so the member 36 may be chemically digested rather than mechanically broken. An important feature of the flapper valve assembly 30 is that it is full opening, by which is meant that the internal passage through the assembly 30 is at least approximately the same diameter, or cross-sectional area, of the pipe joints 24. This allows operations below one or more of the flapper valve assemblies 30 because anything that will pass through the pipe joints 24 will pass through the flapper valve assembliea 30.

Figure 2:
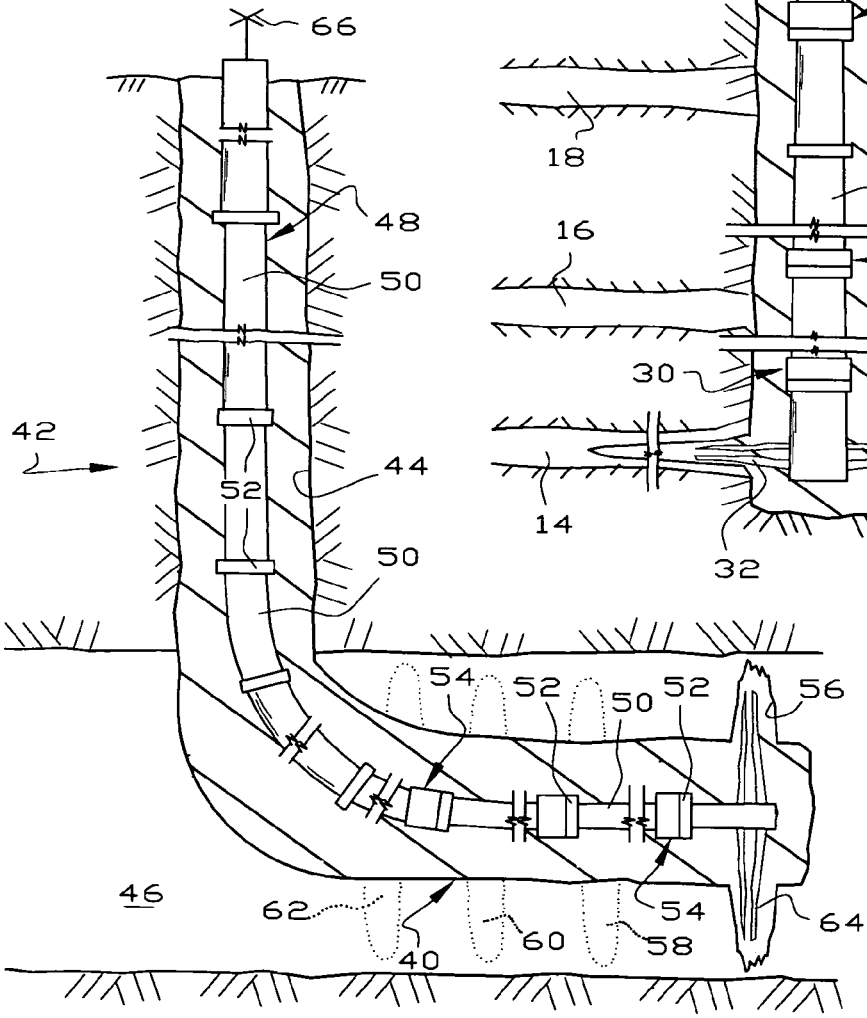
FIG. 2 is a cross-sectional view of a horizontal or deviated well in the earth.

Referring to FIG. 2, operation of this invention in a horizontal leg 40 of a deviated well 42 is illustrated. In FIG. 2, a bore hole 44 is drilled from a surface location through the earth and deviated to pass for a long distance, e.g. more-or-less horizontally, into a hydrocarbon bearing formation 46. A casing string 48 is cemented in the well bore 44 and includes a series of pipe joints 50 connected by threaded couplings or collars 52 and a series of spaced apart flapper valve assemblies 54, which are conveniently identical to the flapper valve assemblies 30 and will be more fully described hereinafter.

The flapper valve assemblies 54 are spaced apart by a distance generally equal to the desired distance between stimulated zones in the formation 46. For example, it is common to frac horizontal wells at 100-300' intervals along the length of the casing string 22 so the flow path from low permeability rock to a high permeability fraced area is decreased significantly. In any event, the most distant flapper valve assembly 54 is spaced between the most distant intended fraced area 56 and the next adjacent intended frac area 58. Additional flapper valve assemblies 54 are placed between adjacent intended frac areas 58, 60, 62 in order to isolate the next zone to be stimulated from affecting any more distant fraced zone or being affected by, the more distant zone. It will be recognized that the most distant zone in a horizontal well is analogous to the deepest zone in a vertical well.

After the casing string 48 is cemented in place, the most distant zone 56 is can be perforated with suitable perforating equipment to produce passages or perforations 64 communicating between the formation 46 and the interior of the casing string 48. The formation 46 is then stimulated in any suitable manner, typically by fracing in which a proppant laden slurry is pumped through the casing string 48 and perforations 64 to create a fraced area in the intended zone 56 of the formation 46. In a conventional manner, the fraced area may extend many hundreds of feet away from the casing string 48 to produce a high permeability path from the formation 48 to the well 42.

In a manner more fully explained hereafter, the most distant flapper valve assembly 54 can be manipulated to allows flapper valve member to move to an operative position preventing downward flow in the casing string 48 and allowing upward flow. This isolates the zone 56 and allows the next adjacent interval 58 to be perforated and stimulated, typically but not necessarily by fraying. After the interval 58 is treated, the flapper valve assembly above the interval 58. which is more accurately described as nearer the surface or well head 66, can be manipulated to isolate the interval 58 and allow the Zone 60 to be perforated and treated. After the interval 60 is treated, the flapper valve assembly above the interval 60 is manipulated to isolate the interval 60 and allow the interval 62 to be perforated and stimulated. It will accordingly be seen that any-number of intervals may be selectively perforated and stimulated in a horizontal well by the use of this invention.

After all of the intervals have been stimulated, the well 42 can be produced to clean up the well. Initially, this is attempted simply by opening the well 42 to the atmosphere or to surface production equipment (not shown) by opening one or more valves at the well head 66. If there is no debris on top of the flapper valve members, the pressure differential across the valve members causes the members to open thereby allowing flow of formation contents to the surface. The well 42 is accordingly put on production without any further substantial cost relating to cleaning up the well. This is in contrast to the current practice of drilling out bridge plugs with a coiled tubing unit which is a costly and risky endeavor.

If there is some debris on top of the flapper valve members, but not too much, the pressure differential across the flapper valve members is sufficient to partly open the valve members allowing formation contents from below any particular flapper valve assembly to fluidize the debris and flow it to the surface. The well 42 is accordingly put on production without any further substantial cost relating to cleaning up the well.

If there is enough debris on top of any particular flapper valve member to prevent it from opening, the debris must be removed. Because the well 42 is highly deviated, it is generally not possible to drop gravity propelled tools to the bottom of the horizontal leg 40. Thus, it is likely necessary to use a coiled tubing unit or workover rig to pass a conduit through the casing string 48 to circulate the debris out of the well and break the flapper valve members. Because the flapper valve members are frangible and of relatively short length, drilling them out is much simpler, easier and less expensive than drilling out a bridge plug.

Figure 4:
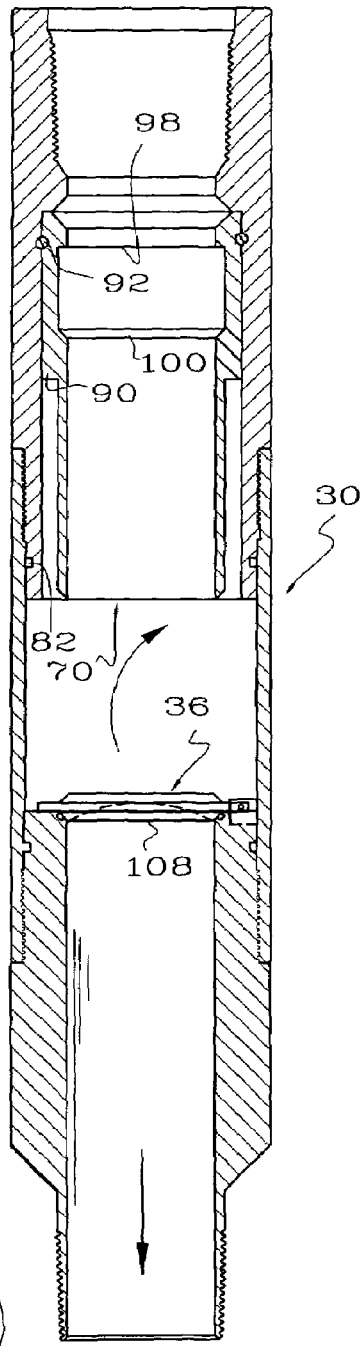
FIG. 4 is a view similar to FIG. 3, illustrating the flapper valve in an operative position blocking flow downwardly into a well.
Figure 3:
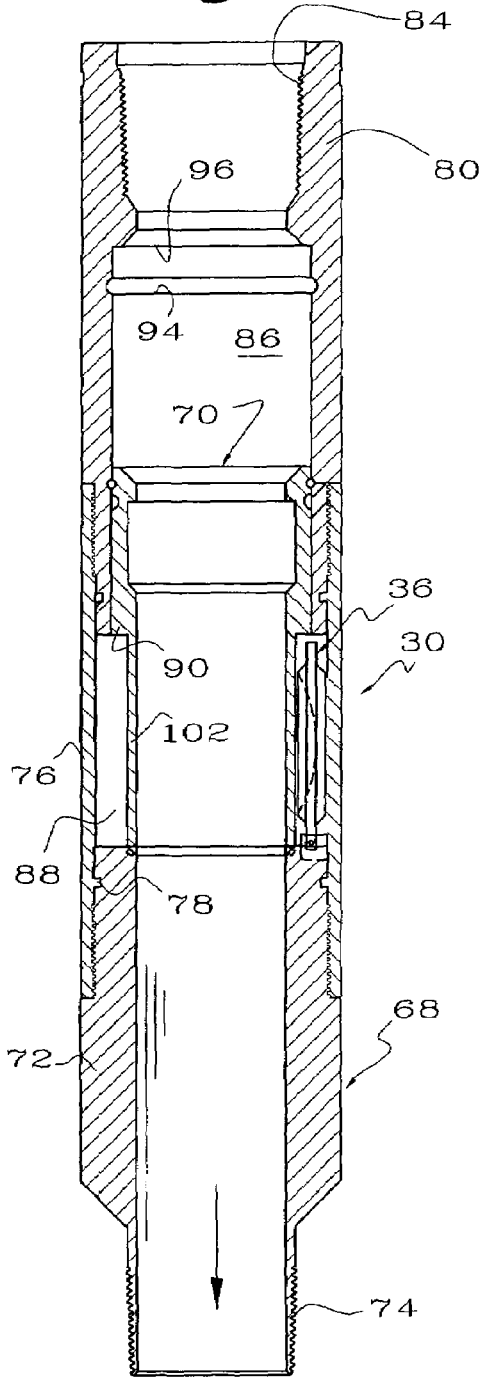
FIG. 3 is an enlarged cross-sectional view of a flapper valve assembly of this invention, illustrating the flapper valve in a stowed or retracted position.
Figure 5:
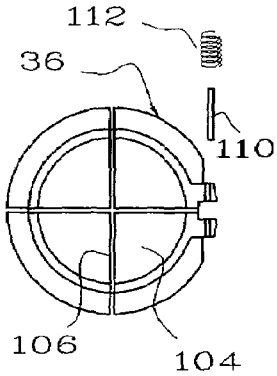
FIG. 5 is an exploded top view of the flapper valve member, pivot pin and spring of this invention.

Referring to FIGS. 3-5, there is illustrated an exemplary flapper valve assembly 30 that may be used in the operation of this invention, as described above in connection with vertical or horizontal wells. The flapper valve assembly 30 comprises, as major components, a tubular housing or sub 68, the flapper valve member 36 and a sliding sleeve 70 or other suitable mechanism for holding the valve member 36 in a stowed or inoperative position. As will be explained more fully hereinafter, any conventional device may be used to shift the sliding sleeve 70 between the position shown in FIG. 3 where the valve member 36 is held in an inoperative position to the position shown in FIG. 4 where the valve member 36 is free to move to a closed position blocking downward movement of pumped materials through the flapper valve assembly 30. Although the mechanism disclosed to shift the sleeve 70 is mechanical in nature, it will be apparent that hydraulic means are equally suitable.

The tubular housing 68 comprises a lower section 72 having a threaded lower end 74 matching the threads of the collars in the casing strings 22, 48, a central section 76 threaded onto the lower section 72 and providing one or more seals 78 and an upper section 80. The upper section 80 is threaded onto the central section 76, provides one or more seals 82 and a threaded box end 84 matching the threads of the pins of the pipe joints 24, 50. The upper section 80 also includes a smooth walled portion 86 on which the sliding sleeve 70 moves.

The function of the sliding sleeve 70 is to keep the flapper valve member 36 in a stowed or inoperative position while the casing string is being run and cemented until such time as it is desired to isolate a formation below the flapper valve member 30. There are many arrangements in flapper valves that are operable and suitable for this purpose but a sliding sleeve is preferred because it presents a smooth interior that is basically a continuation of the interior wall of the casing string thereby allowing normal operations to be easily conducted inside the casing string and it prevents the entry of cement or other materials into a cavity 88 in which the valve member 36 is stowed.

The sliding sleeve 70 accordingly comprises an upper section 90 sized to slide easily on the smooth wall portion 86 and provides an O-ring seal 92 which also acts as a friction member holding the sleeve 70 in its upper position. The upper section 80 of the tubular housing and the upper section 90 of the sliding sleeve 70 accordingly provide aligned partial grooves 94 receiving the O-ring seal 92. When the sleeve 70 is pulled upwardly against the shoulder 96, the O-ring seal 92 passes into the groove 94 and frictionally holds the sleeve 70 in its upper position.

The upper section 90 of the sliding sleeve 70 provides a downwardly facing shoulder 98 and an inclined upwardly facing shoulder 100 providing a profile for receiving the operative elements of a setting tool of conventional design so the sliding sleeve 70 may be shifted from the stowing position of FIG. 3 to the position of FIG. 4, allowing the valve member 36 to move to its operative position.

The sliding sleeve 70 includes a lower section 102 of smaller external diameter than the upper section 90 thereby providing the cavity 88 for the flapper valve member 36. In the down or stowing position, the sliding sleeve 70 seals against the lower section 72 of the tubular housing 68 so that cement or other materials do not enter the cavity 88 and interfere with operation of the flapper valve member 36.

Figure 6:
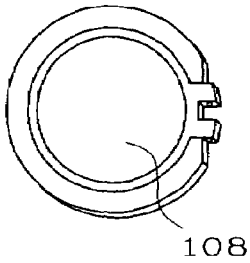
FIG. 6 is a bottom view of the flapper valve member of FIG. 5.

The flapper valve member 36 is shown best in FIGS. 5 and 6 and is made of a frangible material, such as cast aluminum, ceramics, cast iron or the like and may have an upper face 104 crossed by grooves 106 which act as score lines thereby weakening the member 36 against impact forces. The member 36 preferably includes a lower face 108 of downwardly concave configuration in order to increase its ability to withstand high pressure. The flapper valve member 36 is pivoted to the tubular housing 68 in any suitable manner, as by the provision of a pivot pin 110 extending through a spring 112 which acts to bias the flapper valve member 36 downwardly into sealing engagement with the lower housing section 68 thereby sealing the assembly 30 and casing strings against downward fluid flow and allowing upward fluid flow.

The sliding sleeve 70 is manipulated in any suitable manner, as by the provision of the setting or shifting tool of any suitable type. A preferred setting tool is available from Tools International, Inc. of Lafayette, La. under the tradename B Shifting Tool.

Figure 7:
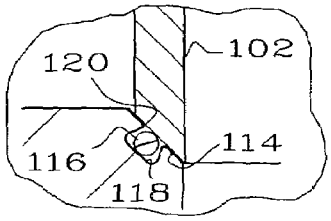
FIG. 7 is a partial enlarged cross-sectional view of the valve seat of FIG. 3.

Referring to FIG. 7, the lower end 114 of the sleeve section 102 is tapered to cover and protect an O-ring 116 located in a groove 118 in a valve seat 120 provided by the lower housing section 72. In this manner, cement or frac slurry does not contact or damage the O-ring 116. In a preferred manner, when the valve member 36 abuts the O-ring 116 at a low pressure differential, the valve member 36 seals against the O-ring 116. When subjected to a high pressure differential, the O-ring 116 is essentially compressed into the groove 118 and the valve member 36 seals against the valve seat 120 in a surface-to-surface type seal.

Operation of the flapper valve assembly 30 should now be apparent. Each flapper valve assembly 30 is assembled in the casing string 22, 48 as it is being run into the hole in the process of cementing. The sliding sleeve 70 is in the down or stowing position so the valve member 36 is not operative. This allows conventional operations to be conducted in the casing string 22, 48. An important feature of the valve assembly 30 is that it is full opening, i.e. the unobstructed inside diameter is at least substantially as large as the internal diameter of the pipe joints 24, 50. When the flapper valve member 36 is stowed in the position of FIG. 3, conventional operations are easily conducted. When the sleeve 70 has been pulled up to allow the flapper valve member 36 to close, and the valve member 36 has been broken, the full opening feature of this invention allows well tools, such as bailers, sinker bars or other tools to pass through the valve assembly 30 and conduct operations below the valve assembly 30.

Normally, communication between the interior of the casing strings 22, 28 and the adjacent hydrocarbon zones is accomplished by perforating. It will be evident, of course, that the casing strings 22, 48 may be provided with subs including a slotted or perforated tubular housing closed off by a slidable sleeve. After the casing string is cemented in the well, the slidable sleeve may be shifted to expose the hydrocarbon zones for fracing or other stimulation.

It may be desirable, particularly in horizontal wells, to orient the flapper valve assemblies 54 so the flapper valve members open in a particular directions, e.g. with the hinge pins 110 uniformly at the top or at the bottom of the wellbore. This may be accomplished in any suitable manner, such as by using a gyroscopic orientation technique, as is well known in the art.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A well comprising:

a bore hole extending from a surface location and penetrating a hydrocarbon bearing interval, a casing string in the bore hole having a predetermined minimum internal diameter, and a flapper valve assembly having:

an internal diameter at least as large as the casing internal diameter and providing a tubular housing providing part of the casing siring and being at a location between the hydrocarbon bearing interval and the surface location, a flapper valve member movable between a first inoperative position allowing upward and downward flow through the casing string and a second operative position allowing upward flow and preventing downward flow through the casing string, and a manipulable device for holding the flapper valve member in the first position, the manipulable device comprises a sliding sleeve having a lower position holding the flapper valve in a stowed position and an upper position allowing the flapper valve to move to the second operative position allowing upward flow and preventing downward flow through the casing string, the sliding sleeve protecting the flapper valve from accumulating debris in the stowed position, a first end of the sleeve having a downwardly facing shoulder for receiving operative elements of a setting tool and thereby pulling the sliding sleeve upwardly into the upper position, and a second end of the sleeve adapted to sealingly engage the tubular housing when the flapper valve is disposed at the first position.

2. The well of claim 1 wherein the well includes a section deviating substantially from the vertical and passing a substantial distance in the hydrocarbon bearing interval, the flapper valve assembly being intermediate the ends of the hydrocarbon bearing formation and separating the casing into two treatment zones.

3. The well of claim 2 comprising a multiplicity of flapper valve assemblies intermediate the ends of the hydrocarbon bearing formation separating the casing into a multiplicity of treatment zones.

4. The well of claim 1 wherein the flapper valve member is of a frangible material.

5. The well of claim 4 wherein the flapper valve members are made of a material selected from the group consisting of cast aluminum, cast iron and ceramics.

6. The well of claim 1 wherein the flapper valve member is of an acid soluble material.

7. The well of claim 1 wherein the tubular housing comprises a lower section providing an upwardly facing frustoconical valve seat having an O-ring thereon for sealing against the flapper valve member when disposed in the second position, and wherein the second end of the sleeve is frustoconical and complements the upwardly facing frustoconical valve seat in the tubular housing, providing a seal against the O-ring.

8. The well of claim 1 wherein the second end of the sleeve is tapered and adapted to sealing engage the upwardly Lacing frustoconical valve seat in the tubular housing.

9. A flapper valve assembly comprising a tubular housing having an upper end, a lower end, a pocket between the upper and lower ends for receiving a flapper valve member and an upwardly facing valve seat providing a resilient seal therein;

a flapper valve member mounted for a movement between a first position in the pocket for allowing upward and downward flow therethrough and a second position abutting the resilient seal and preventing flow toward the lower housing end; and a shiftable sleeve for holding the flapper valve member in the first position while closing the pocket and for releasing the flapper valve member for movement to the second position, the shiftable sleeve having an end for sealing engagement with the upwardly facing resilient seal when the flapper valve member is in the first position, the sleeve and sleeve end sealing the pocket against entry of debris.

10. The flapper valve assembly of claim 9 wherein the resilient seal comprises an O-ring seal and the shiftable sleeve end provides a surface sealing thereagainst.

11. The flapper valve assembly of claim 10 wherein the upwardly facing valve seat is of frustoconical shape and the sealing surface of the shiftable sleeve end is of a complementary frustoconical shape.

12. The flapper valve member of claim 9 wherein the shiftable sleeve is mounted for movement toward the upper end thereby allowing movement of the flapper valve member toward the second position.

13. The flapper valve assembly of claim 9 wherein the end of the shiftable sleeve for sealing engagement with the upwardly facing resilient seal is tapered.

* * * * *